US008387703B2

(12) United States Patent
Finn et al.

(10) Patent No.: US 8,387,703 B2
(45) Date of Patent: Mar. 5, 2013

(54) TUBE BUOYANCY CAN SYSTEM

(75) Inventors: Lyle David Finn, Sugarland, TX (US); Edmund Muehlner, Houston, TX (US)

(73) Assignee: Horton Wison Deepwater, Inc., Houston, TX (US)

( * ) Notice: Subject to any disclaimer, the term of this patent is extended or adjusted under 35 U.S.C. 154(b) by 715 days.

(21) Appl. No.: 12/250,117

(22) Filed: Oct. 13, 2008

(65) Prior Publication Data

US 2009/0095485 A1 Apr. 16, 2009

Related U.S. Application Data

(60) Provisional application No. 60/979,507, filed on Oct. 12, 2007.

(51) Int. Cl.
*E21B 17/01* (2006.01)

(52) U.S. Cl. ..... 166/350; 166/345; 166/367; 405/224.2; 441/29

(58) Field of Classification Search ..... 166/350, 166/345, 351, 352, 355, 367; 405/205, 200, 405/224.2, 224.4; 114/256, 264–266, 293; 441/3–5, 28, 29
See application file for complete search history.

(56) References Cited

U.S. PATENT DOCUMENTS 3,855,656 A * 12/1974 Blenkarn ..... 441/22
4,099,560 A * 7/1978 Fischer et al. ..... 166/350
4,487,150 A 12/1984 Shanks
4,850,744 A * 7/1989 Petty et al. ..... 405/224
4,906,139 A * 3/1990 Chiu et al. ..... 405/223.1
4,913,238 A * 4/1990 Danazcko et al. ..... 405/223.1
5,439,321 A * 8/1995 Hunter ..... 405/195.1
6,004,074 A * 12/1999 Shanks, II ..... 405/195.1
6,092,483 A * 7/2000 Allen et al. ..... 114/264
6,155,748 A * 12/2000 Allen et al. ..... 405/195.1
6,161,620 A * 12/2000 Cox et al. ..... 166/367
6,213,045 B1 * 4/2001 Gaber ..... 114/266
6,227,137 B1 * 5/2001 Allen et al. ..... 114/264
6,263,824 B1 * 7/2001 Balint et al. ..... 114/264
6,309,141 B1 * 10/2001 Cox et al. ..... 405/224
7,156,040 B2 * 1/2007 Merchant et al. ..... 114/293
7,413,384 B2 * 8/2008 Horton et al. ..... 405/224.2
7,537,416 B2 * 5/2009 Wetch ..... 405/224.2
7,553,106 B2 * 6/2009 Horton et al. ..... 405/195.1
7,565,877 B2 * 7/2009 Sablok et al. ..... 114/264
8,083,439 B2 * 12/2011 Wetch ..... 405/224.2

OTHER PUBLICATIONS

PCT/US2008/079703 International Search Report, Dec. 30, 2008.

* cited by examiner

*Primary Examiner* — Matthew Buck
(74) *Attorney, Agent, or Firm* — Conley Rose, P.C.

(57) ABSTRACT

A tube buoyancy can system for tensioning a top tension riser. In some embodiments, the system includes a tubular can coupled to the top tension riser and a pressurized gas system configured to selectably inject pressurized gas into the tubular can. The tubular can includes an enclosed upper end having at least one closeable opening therethough, an open lower end configured to allow seawater to flow freely into and out of the tubular can, and an inner surface extending therebetween. The inner surface is devoid of structural obstructions which substantially inhibit the free flow of seawater through the lower end. When the opening is open, the tubular can is ballasted by seawater. When the opening is closed and pressurized gas is injected into the tubular can, the tubular can is de-ballasted of seawater.

16 Claims, 8 Drawing Sheets

TUBE BUOYANCY CAN SYSTEM

CROSS-REFERENCE TO RELATED APPLICATIONS

This application claims benefit of U.S. provisional application Ser. No. 60/979,507 filed Oct. 12, 2007, and entitled "Systems and Methods for Tube Buoyancy Cans," which is hereby incorporated herein by reference in its entirety for all purposes.

STATEMENT REGARDING FEDERALLY SPONSORED RESEARCH OR DEVELOPMENT

Not Applicable.

BACKGROUND

Embodiments of the invention relate generally to buoyancy cans for tensioning risers. More particularly, embodiments of the invention relate to a tube buoyancy can system for providing an adjustable tension load to a top-tensioned riser.

Marine risers are typically employed for offshore platforms to provide conduits between the platform and the seabed. Marine drilling risers are used to guide a drillstring and convey fluids used during various offshore drilling operations. Marine production risers establish a flow path for hydrocarbons produced from a subsea reservoir to a production facility located at the water surface. Other types of marine risers exist. Even so, the functions of marine risers can be generally summarized as the transfer of matter, power or signals between the seabed and the water surface.

Common to all types of marine risers is that due to their weight, a certain amount of vertical force is necessary to keep the riser upright and prevent it from dropping to the seafloor. Moreover, vertically arranged marine risers must be over-tensioned beyond their self weight in order to limit the deflections and stresses in the riser due to exposure to the dynamic ocean environment. Such vertically arranged and tensioned risers are commonly known as top tension risers. In addition to the tension requirement, risers attached to a floating drilling or production vessel must be decoupled from the vessel's heave motion, which is induced by wave action.

The two commonly used types of riser tensioning devices are hydraulic actuators and buoyancy cans. For a hydraulic riser tensioner, hydraulic actuators are attached between the vessel and the top of the riser. Vessel heave is compensated by actuator stroke, while the riser tension is maintained at a substantially constant level by actively controlling the hydraulic pressure. Buoyancy can tensioners, on the other hand, are passive devices attached to the upper portion of risers below the waterline. The riser tension is provided by buoyancy, while vessel heave is compensated by allowing the buoyancy can to slide up and down relative to the host vessel in sleeve-type guides. Conventionally, both hydraulic tensioners and buoyancy cans are applied to a single riser. Where a plurality of risers is to be supported, each riser is tensioned individually by a separate tensioner.

Irrespective of the type of riser tensioner, the functional requirements for operation in deep water and harsh ocean environments provide significant technological challenges for their design. Riser weight and consequently the tensioner capacity requirement increase with water depth. Tensioner stroke requirements increase with increasing motions of the host vessel, which, in turn, are a result of the severity of the wave environment. Some buoyancy cans, such as those disclosed by U.S. Pat. No. 6,884,003, allow the support of multiple risers. When such multi-riser buoyancy cans operate with less than the full complement of risers, the buoyancy can must be ballasted to prevent over-tensioning the risers. Due to the additional ballast, heave periods of the buoyancy cans may shift into a range where appreciable wave energy exists, resulting in increased dynamic loads to the risers. Because of these design constraints, the tensioners used for the latest generation of drilling or production vessels are large, complex, and expensive. For some applications, the load and stroke requirements have reached the limits of existing tensioner technology.

Exploration and production in even deeper waters and harsher environments demand new technologies that overcome current limitations. Moreover, operational flexibility and cost reduction on marine riser systems has become increasingly important for the oil & gas industry, as this industry is confronted with more economically challenging reservoirs in deep waters. Accordingly, embodiments of the invention are directed to buoyancy can systems and associated methods that seek to overcome these and other limitations of the prior art.

SUMMARY OF THE PREFERRED EMBODIMENTS

A tube buoyancy can system and associated methods for tensioning a top tension riser are disclosed. In some embodiments, the system includes one or more tubular cans coupled to the top tension riser and a pressurized gas system configured to selectably inject pressurized gas into the tubular can. Each tubular can includes an enclosed upper end having at least one closeable opening therethrough, an open lower end configured to allow seawater to flow freely into and out of the tubular can, and an inner surface extending therebetween. The inner surface is devoid of structural obstructions which substantially inhibit the free flow of seawater through the lower end. When the opening is open, the tubular can is ballasted by seawater. When the opening is closed and pressurized gas is injected into the tubular can, the tubular can is de-ballasted of seawater.

Some methods for adjustably tensioning the top tension riser include coupling the tubular can to the top tension riser, opening the closeable opening, whereby the tubular can is ballasted with seawater, whereby a tension load applied to the top tension riser by the tubular can is decreased. The methods further include closing the closeable opening and injecting pressurized gas into the tubular can, whereby the tubular can is de-ballasted of seawater, whereby the tension load increases.

Some embodiments of a tubular buoyancy can system for tensioning a top tension riser include one or more tubular cans, each tubular can configurable between a de-ballasted configuration and a ballasted configuration. In the de-ballasted configuration, each tubular can has a first natural heave period. In the ballasted configuration, each tubular can has a second natural heave period. The first natural heave period and the second natural heave period are substantially the same.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
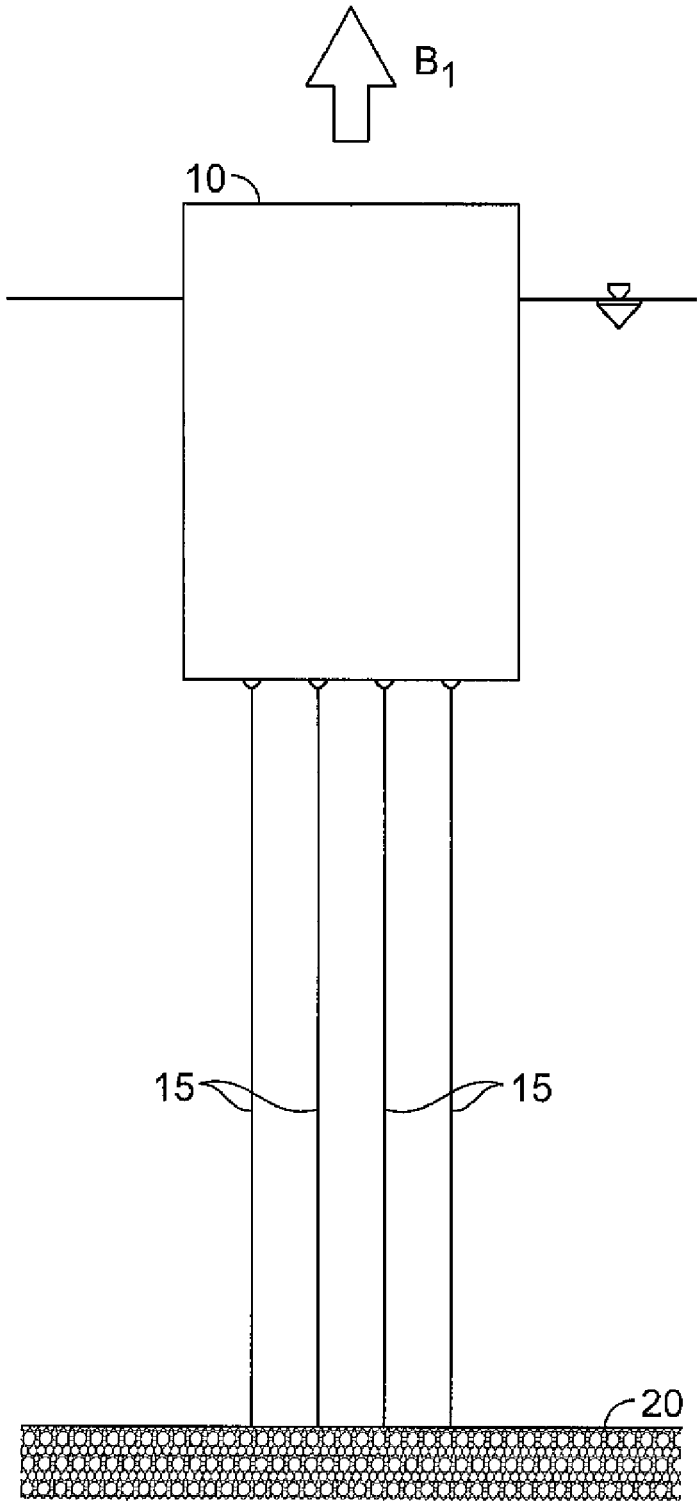
FIG. 1 (Prior Art)
FIG. 1 is a schematic representation of a conventional multi-riser buoyancy can system.

Various embodiments of the invention will now be described with reference to the accompanying drawings, wherein like reference numerals are used for like parts throughout the several views. The figures are not necessarily to scale. Certain features of the invention may be shown exaggerated in scale or in somewhat schematic form, and some details of conventional elements may not be shown in the interest of clarity and conciseness.

In the following discussion and in the claims, the terms "including" and "comprising" are used in an open-ended fashion, and thus should be interpreted to mean "including, but not limited to . . . ". Also, the terms "couple," "couples", and "coupled" used to describe any connections are each intended to mean and refer to either an indirect or a direct connection.

The preferred embodiments of the invention relate to buoyancy can systems used in floating platforms. The invention is susceptible to embodiments of different forms. There are shown in the drawings, and herein will be described in detail, specific embodiments of the invention with the understanding that the present disclosure is to be considered an exemplification of the principles of the invention and is not intended to limit the invention to that illustrated and described herein. It is to be fully recognized that the different teachings of the embodiments discussed below may be employed separately or in any suitable combination to produce desired results.

To understand and appreciate the novelty of the invention, a brief discussion of conventional buoyancy can systems, their operation and associated behavior is first presented. Referring to FIG. 1, an exemplary conventional buoyancy can system 10 is depicted. Buoyancy can system 10 suspends four top tension risers 15 coupled to the seabed 20 below. For convenience, risers 15 are identical with regard to structure and weight. The tension load applied to risers 15 by buoyancy can system 10 is equal to the buoyancy of system 10, symbolically represented as $B_1$ in this figure. Thus, buoyancy can system 10 is configured or sized to have sufficient buoyancy $B_1$ to apply the required tension load to risers 15 so that risers 15 remain suspended above the seabed 20.

Figure 2:
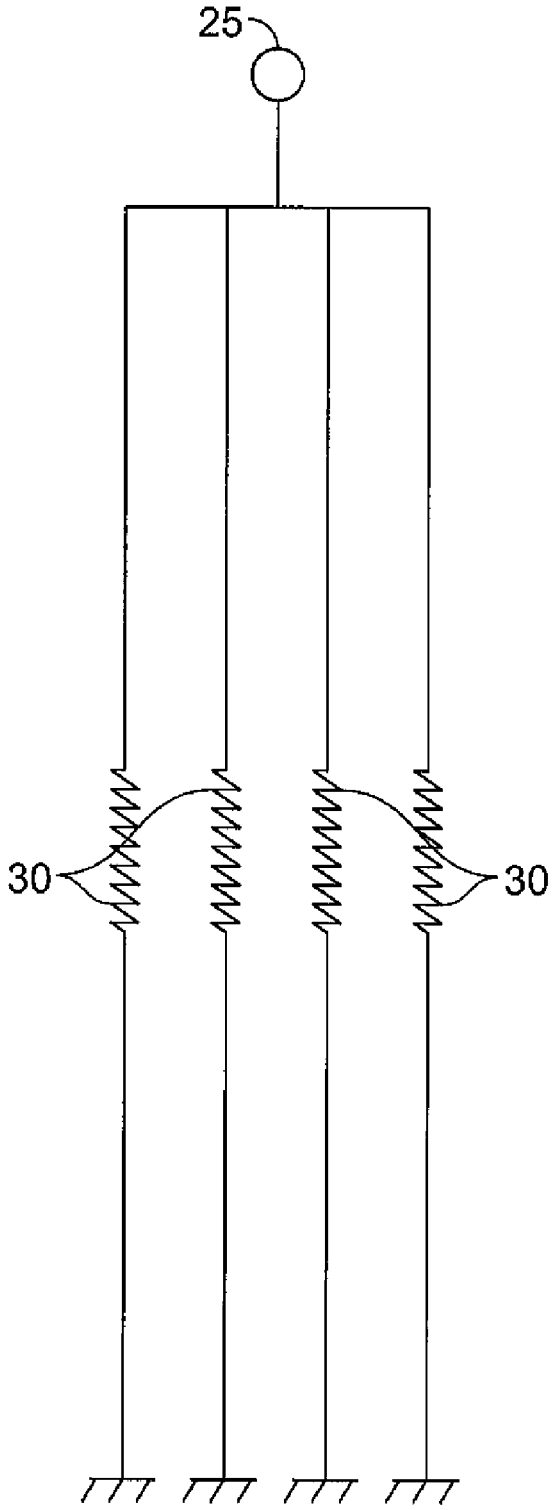
FIG. 2 (Prior Art)
FIG. 2 is a schematic representation of a mechanical analog of the conventional buoyancy can system of FIG. 1.

Turning now to FIG. 2, a simple mechanical analog of the buoyancy can system 10 and risers 15 of FIG. 1 is depicted. In this analog, buoyancy can system 10 is represented by a mass 25 having a mass $M_1$ equal to the mass of buoyancy can system 10. Each of risers 15 are represented by a single spring 30 having a stiffness c. The natural heave period $T_1$ of buoyancy can system 10 can be determined as a function of the mass of buoyancy can system 10, or $M_1$, the stiffness c of each riser 15, and the number N of installed risers 15 in accordance with the following equation:

$$T_1 = 2\pi\sqrt{\frac{M_1}{Nc}}$$

As seen from the above equation, the natural heave period $T_1$ of buoyancy can system 10 increases with increasing mass $M_1$ of buoyancy can system 10.

Figure 3:
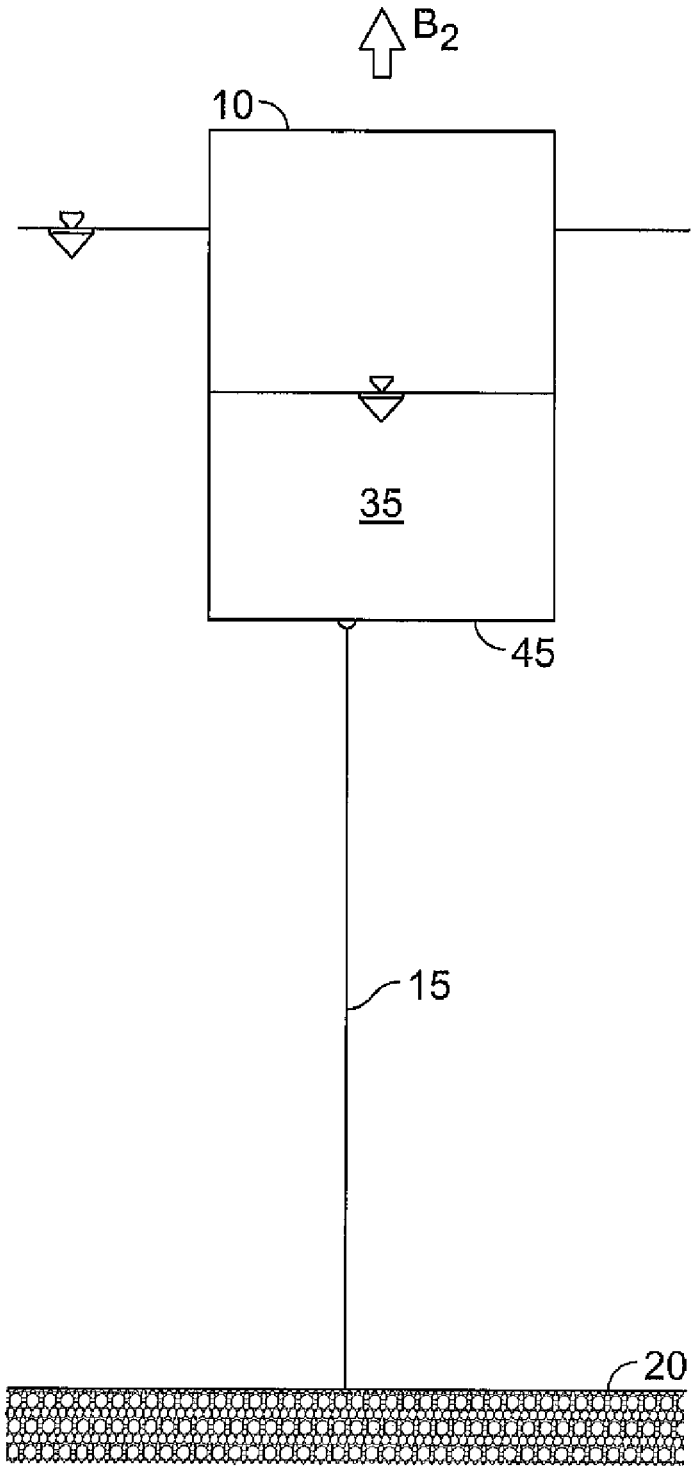
FIG. 3 (Prior Art)
FIG. 3 is a schematic representation of the conventional buoyancy can system of FIG. 1 with only one riser installed.

To suspend risers 15 from buoyancy can system 10, as shown in FIG. 1, each riser 15 is typically installed one at a time. Because buoyancy can system 10 is sized to adequately tension four risers 15, the buoyancy capacity of system 10 provides a tension load exceeding that required to support fewer than four risers 15. To avoid over-tensioning the first installed riser(s) 15, ballast 35, typically seawater, is introduced to buoyancy can system 10, as illustrated by FIG. 3. The amount of ballast 35 added to buoyancy can system 10 is determined as a function of the maximum allowable tension load $B_2$ for the single installed riser 15. Thus, ballast 35 is added to buoyancy can system 10 until the buoyancy of system 10 is at most $B_2$.

Figure 4:
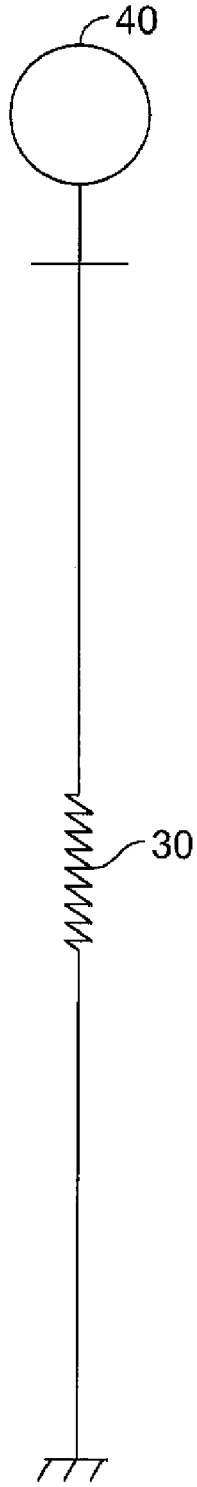
FIG. 4 (Prior Art)
FIG. 4 is a schematic representation of a mechanical analog of the conventional buoyancy can system of FIG. 3.

Turning now to FIG. 4, a simple mechanical analog of the buoyancy can system 10 and the single installed riser 15 of FIG. 3 is depicted. In this analog, buoyancy can system 10 is represented by a mass 40 having a mass $M_2$ equal to the mass of buoyancy can system 10, while the single installed riser 15 is again represented by a single spring 30 having stiffness c. As before, the natural heave period $T_2$ of buoyancy can system 10 is a function of the mass of buoyancy can system 10, or $M_2$, the stiffness c of riser 15, and the number N of installed risers 15, in accordance with the following equation:

$$T_2 = 2\pi\sqrt{\frac{M_2}{Nc}}$$

Because conventional buoyancy can systems, like system 10, are enclosed, particularly at their base 45 (FIG. 3), seawater added as ballast 35, is contained within system 10. Due to its containment, seawater ballast 35 moves with system 10 in response to surrounding wave motions. As such, ballast 35 effectively increases the mass of system 10 by an amount equal to the mass of ballast 35, which, in turn, increases the natural heave period $T_2$ of system 10. Waves having natural periods in the range 5 to 15 seconds have appreciable energy. When sufficient ballast 35 is added to buoyancy can system 10 such that the natural heave period $T_2$ of system 10 falls within this range, the single installed riser 15 may experience tension loads in excess of its design allowable.

Figure 5:
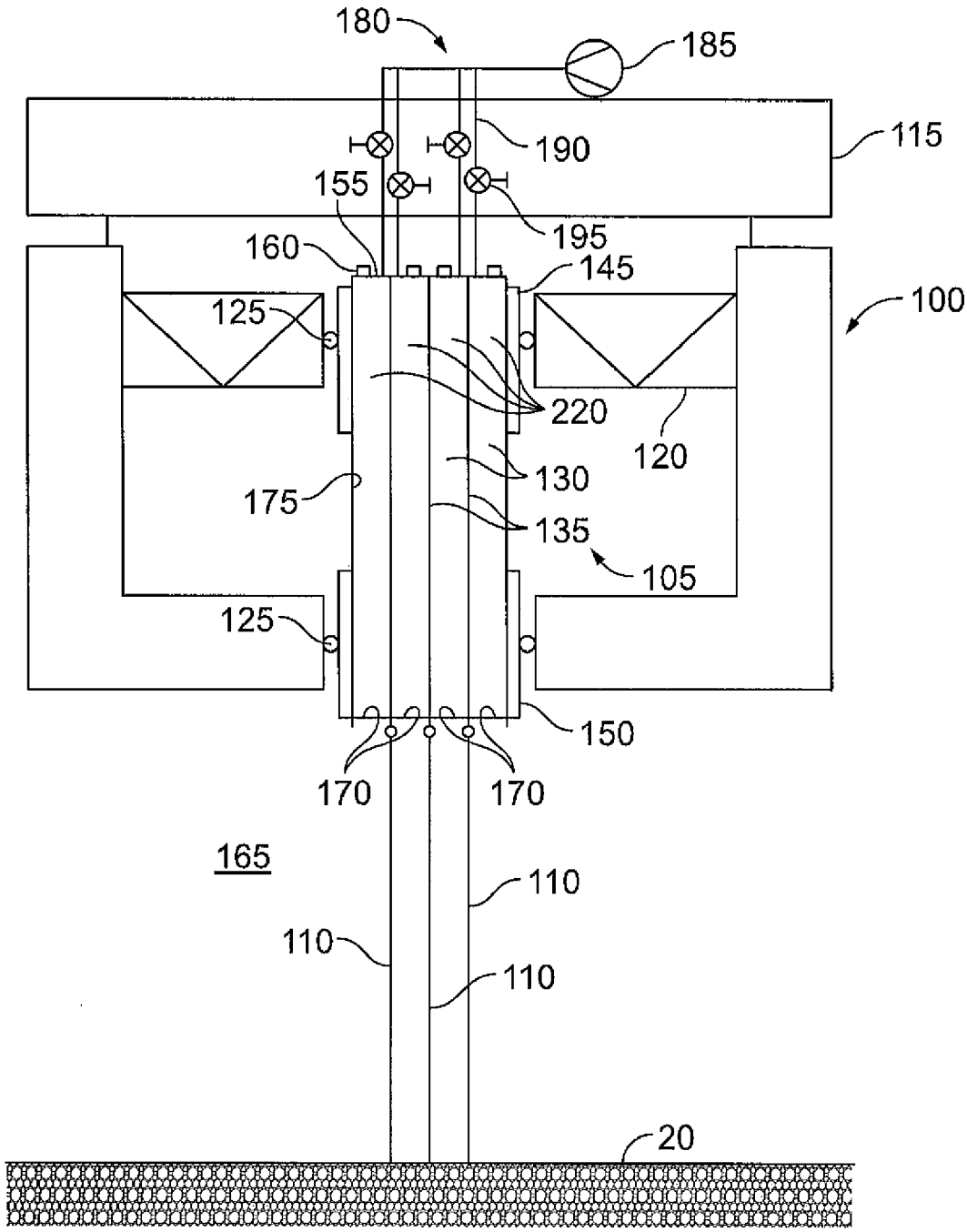
FIG. 5 is a schematic representation of a floating vessel with a tube buoyancy can system in accordance with the principles disclosed herein.

Embodiments of the invention are directed to tube buoyancy can systems and associated methods which enable adjustment of the system buoyancy, and thus the tension load to one or more top tension risers suspended therefrom, without appreciable impact to the natural period of the buoyancy can system. Turning now to FIG. 5, a floating vessel 100 is depicted with a tube buoyancy can system 105 in accordance with the principles disclosed herein coupled thereto. Floating vessel 100 is any type of floating structure to which one or more top tension risers 110 may be coupled, such as but not limited to a spar or tension leg platform. Floating vessel 100 supports a topside 115 and includes a truss 120 to centralize tube buoyancy can system 105. Floating vessel 100 further includes a plurality of lateral supports 125 disposed between tube buoyancy can system 105 and vessel 100 to enable tube buoyancy can system 105 to rise and fall with surrounding wave motions relative to vessel 100 with minimal resistance. In some embodiments, lateral supports 125 are rollers.

Tube buoyancy can system 105 is configured to suspend one or more top tension risers 110 coupled to the seabed 20 below. Thus, the buoyancy capacity of system 105 is sufficient to suspend all of the one or more risers 110 once installed. The tension load applied to risers 110 by tube buoyancy can system 105 is equal to the buoyancy of system 105, which, as described below, is selectably adjustable to ensure that the one or more risers 110 are tensioned to desired levels. The buoyancy of system 105, and thus the tension load applied to risers 110, is limited by the buoyancy capacity of system 105.

Figure 6:
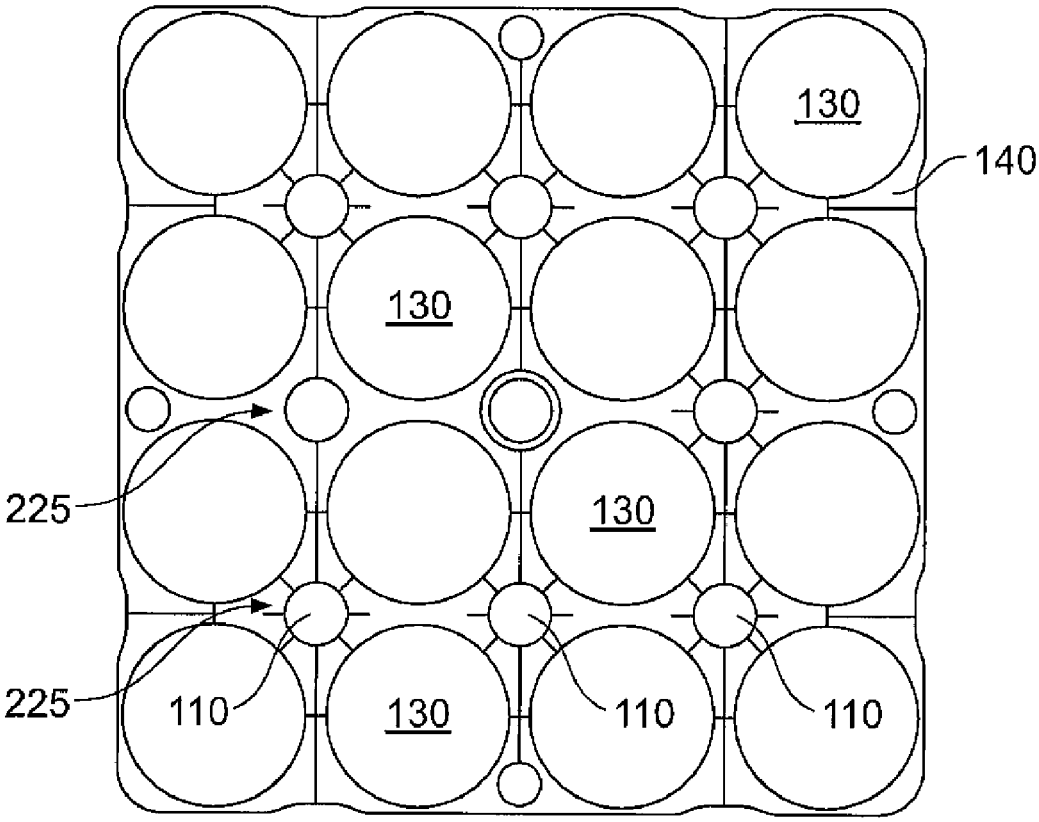
FIG. 6 is a schematic representation of a cross-section through the tube buoyancy can system and risers of FIG. 5.

Tube buoyancy can system 105 includes one or more buoyancy cans 130 coupled together such that cans 105 move collectively as a single unit in response to motions. In some embodiments, cans 130 are coupled by a plurality of vertical and horizontal plates 135, 140, respectively, the latter illustrated in FIG. 6. Still referring to FIG. 5, each buoyancy can 130 is tubular in shape having an upper end 145 and a lower end 150. In some embodiments, risers 110 are positioned within the interstitial spaces 225 between cans 130 (FIG. 6), while in other embodiments, one or more of risers 110 extend through can 130. At upper end 145, can 130 includes a lid 155 with one or more removable closure devices 160 coupled thereto. Lid 155 prevents air flow into or out of can 130 through upper end 145 when device 160 is installed on lid 155. When closure device 160 is decoupled or removed from lid 155, air is permitted to freely flow into and out of can 105 through upper end 145. The size and configuration of closure device 160 enables the free flow of air in this manner without appreciable obstruction. In some embodiments, closure device 160 is a manhole cover. One skilled in the art will readily appreciate that each lid 155 may, in some embodiments, include one or more closure devices 160 that are each selectably actuatable, electronically or otherwise, between an open position and a closed position to permit or prevent, respectively, the free flow of air into or out of can 130 through upper end 145.

At lower end 150, can 130 is open to allow the free flow of seawater 165 into and out of the interior of can 130, as indicated by the water level 170 identified within each can 130. Further, the inner surface 175 of each can 105 is devoid of stiffeners or other structural features which may inhibit the free flow of seawater 165 in this manner. Hence, seawater 165 is free to flow into or out of can 130 through lower end 150 in response to the surrounding wave motions, obstructed only by the pressure of gas 220 contained in can 130 above water level 170. When closure device(s) 160 is removed, air at atmospheric pressure is contained within can 130 above water level 170. This atmospheric air is a negligible obstruction to the free flow of seawater 165 into can 130. As seawater 165 rises within can 130, the atmospheric air is forced from can 130 through upper end 145 as the level 170 of seawater 165 in can 130 rises. However, when closure device 160 is coupled to can 130, such that the free flow of air through upper end 145 is prevented, air trapped within can 130 above water level 170 is compressed as the water level 170 rises due to the influx of seawater 165 into can 130 through lower end 150. Thus, the entrapped air resists or obstructs the free flow of seawater 165 into can 130, and prevents further influx when the pressure of the entrapped air exceeds the pressure of seawater 165 entering can 130.

Tube buoyancy can system 105 further includes a pressurized gas system 180 having a pressurized gas source 185 and a plurality of flow lines 190 extending therefrom. Pressurized gas source 185 may be positioned on topside 115 of vessel 100, as shown, or at another location on vessel 100 or buoyancy can system 105, and is configured to inject pressurized gas, such as but not limited to air or nitrogen, into flow lines 190. In some embodiments, pressurized gas source 185 may be a compressor or storage tank containing pressurized gas. Flow lines 190 extend between source 180 and each lid 155 of cans 130, and are configured to provide the pressurized gas from source 185 to interiors of cans 105. Pressurized gas system 180 further includes one or more valves 195 positioned along each flow line 190. Valves 195 are actuatable, manually or otherwise, to open and close flow line 190 to permit or prevent, respectively, gas flow therethrough. Further, pressurized gas system 180 is configured to selectably inject pressurized gas from source 180 into the interior of cans 130 such that each can 130 may be pressurized independently of the other cans 130. As will be described, cans 130 are pressurized in this manner to de-ballast them of seawater 165 contained therein, so as to increase the buoyancy of buoyancy can system 105 and increase the tension load to risers 110 suspended from system 105.

Figure 7:
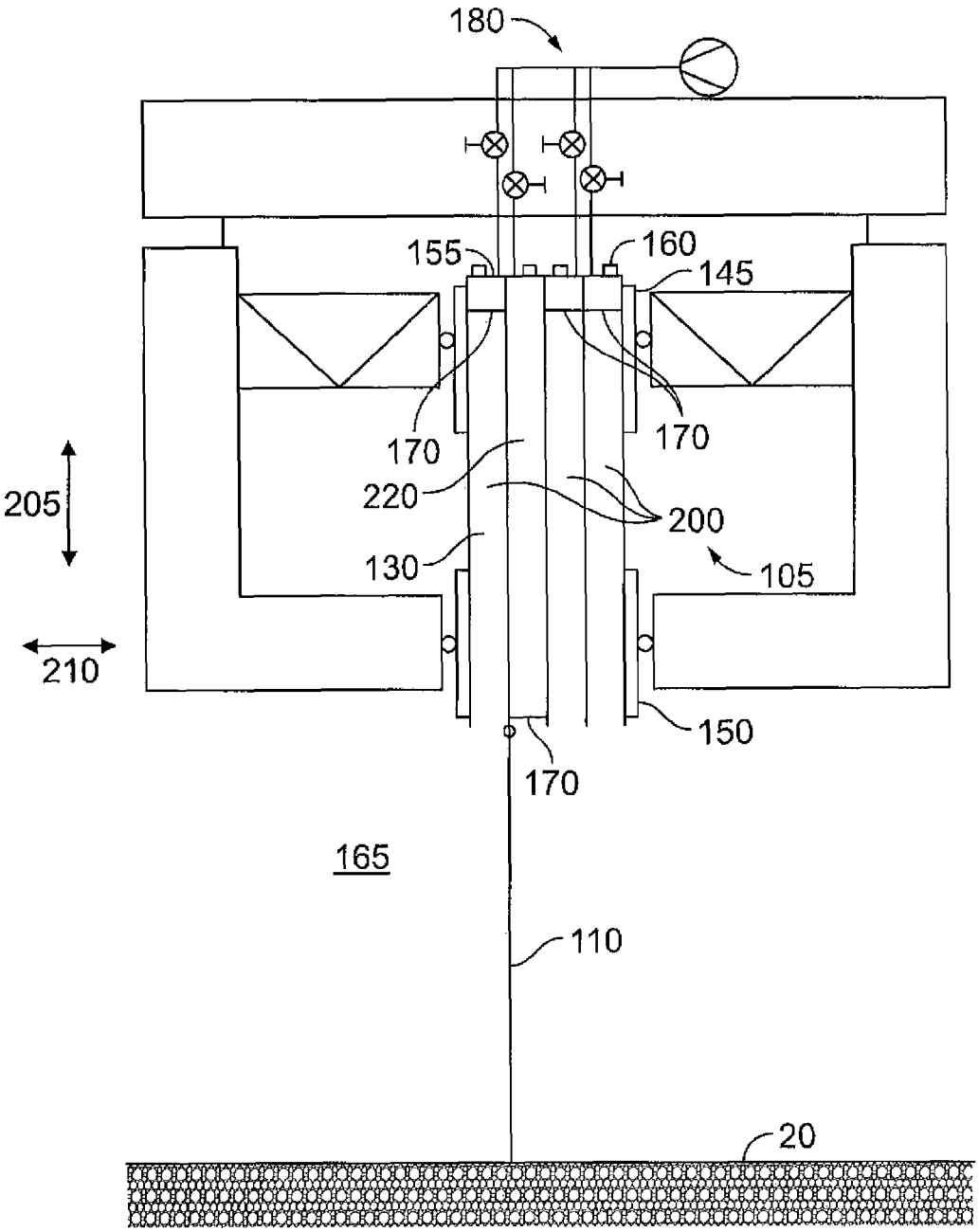
FIG. 7 is a schematic representation of the floating vessel and tube buoyancy can system of FIG. 5 within only one riser installed.

As previously mentioned, installation of risers 110 occurs one at a time. Referring now to FIG. 7, buoyancy can system 105 is depicted with a single installed riser 110. The buoyancy capacity of system 105 provides a tension load which exceeds the structural capacity of this single riser 110. Therefore, it is necessary to reduce the buoyancy of system 105 below its capacity and thus, the tension load on riser 110. To reduce the buoyancy of system 105 to acceptable levels, one or more closure devices 155 are removed to allow air contained within one or more cans 130 to freely exhaust through their respective upper ends 145 and, in response, seawater 165 to flow freely into the affected cans 105 through their respective lower ends 150. As seawater 165 flows into buoyancy can system 105 in this manner, the buoyancy of system 105 decreases to a level which results in a tension load to riser 110 no greater than its design allowable.

Further, in contrast to conventional buoyancy can systems, like system 10 of FIGS. 1 and 3, seawater 165 that has entered into cans 130 from which closure devices 155 have been removed, or seawater ballast 200, is not enclosed or contained within cans 130. As a result, seawater ballast 200 does not move in the vertical direction 205 with cans 130 as cans 130 rise and fall in response to surrounding wave motions. Therefore, seawater ballast 200 does not effectively increase the mass of system 105, and, in turn, the natural heave period of system 105. It bears mentioning that seawater ballast 200 is, however, contained by cans 130 such that seawater ballast 200 moves with cans 130 in the lateral direction 210 in response to wave motions. However, neither movement of seawater ballast 200 nor of cans 130 in the lateral direction 210 affects the heave motion of buoyancy can system 105 or its natural heave period.

Figure 8:
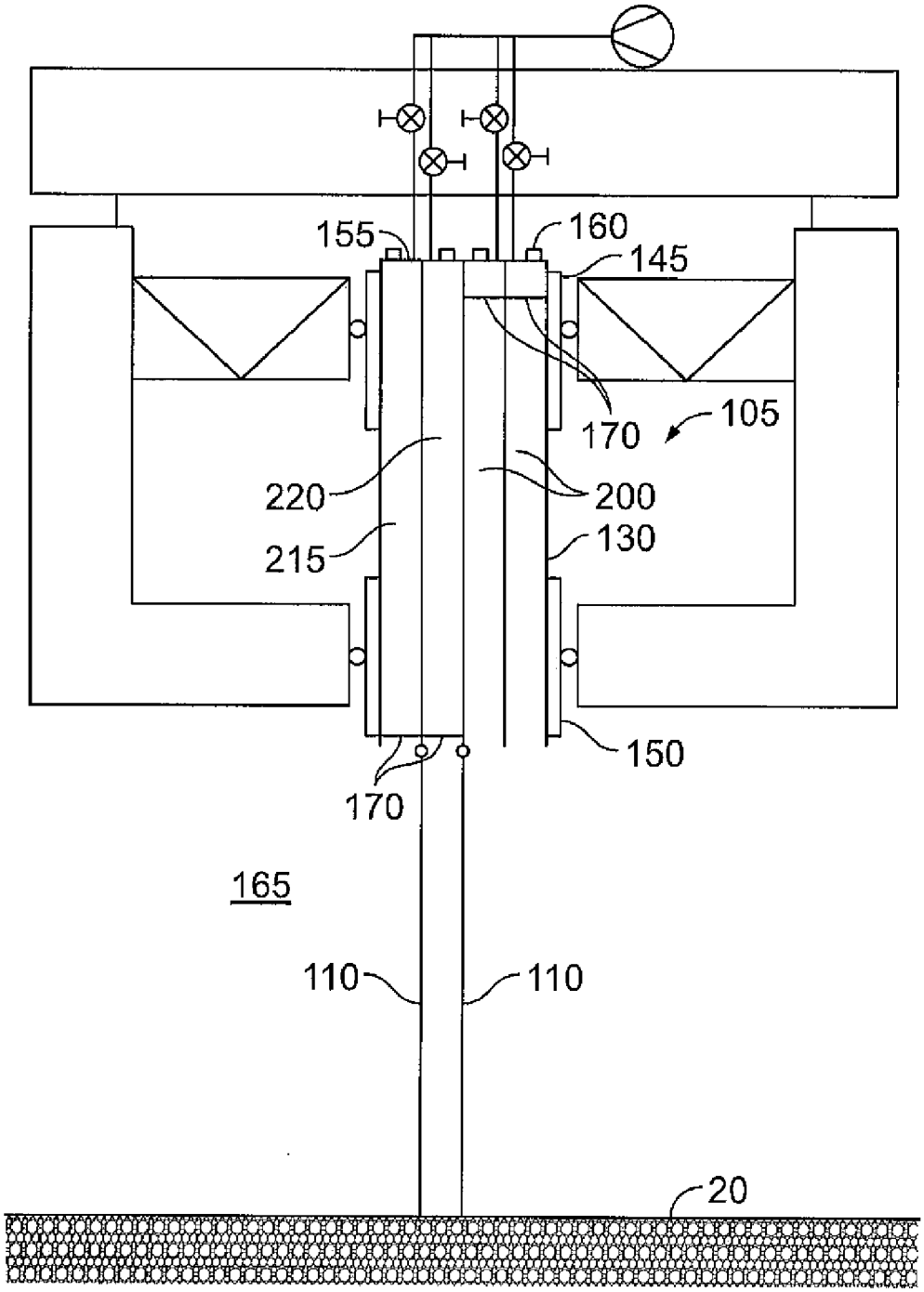
FIG. 8 is a schematic representation of the floating vessel and tube buoyancy can system of FIG. 5 within a second riser installed.

At this point, a second riser 110 may be installed. To provide adequate tension to the now two installed risers 110, as shown in FIG. 8, buoyancy can system 105 is de-ballasted by purging at least a portion of seawater ballast 200 from one or more cans 130. The closure device 155 of one or more cans 130 is re-coupled or re-installed to lids 160, thereby sealing upper ends 145 of the affected cans 130 to prevent the free flow of air therethrough. Pressurized gas source 185 is subsequently actuated to inject pressurized gas 215 into the interiors of the now sealed cans 130 containing seawater ballast 200. As the pressure of gas within cans 130 increases, seawater ballast 200 is forced from cans 130 through lower ends 150 and replaced with pressurized gas 215. When cans 130 are de-ballasted to a degree where the tension load on risers 110 reaches the desired level, injection of gas 215 into cans 130 is discontinued.

Subsequent risers 110 may be installed and tensioned to desired levels by de-ballasting tube buoyancy can system 105 using pressurized gas system 180 in the same manner. Conversely, in some circumstances, it may be desirable to remove one or more of the installed risers 110 and ballast buoyancy can system 105 to reduce the buoyancy of system 105, and thus the tension load to the remaining risers 110, by following the same methods described above but in essentially reverse order. As described, tube buoyancy can system 105 enables adjustment of its buoyancy to accommodate tension loads to risers 110 suspended therefrom without significantly shifting the natural heave period of system 105 toward or into a range where appreciable wave energy exists. The practical benefits of this may be better appreciated by comparing the following Tables 1 and 2.

Table 1 includes heave periods for a conventional buoyancy can system 300 as a function of water depth and the number of risers suspended from the system 300. As shown, the heave period for conventional buoyancy can system 300 exceeds 5 seconds for all water depths illustrated until at least a third riser is installed. If system 300 were used to suspend a drilling riser for use in a drilling operation in 6,000 feet of water, for example, three additional dummy risers would need to be installed in order to reduce the heave period of system 300 below 5 seconds. The addition of three such dummy risers to the drilling operation adds significant expense to an already costly operation.

TABLE 1

| | Water Depth, ft | | | | | | |
|---|---|---|---|---|---|---|---|
| | 4,000 | 5,000 | 6,000 | 7,000 | 8,000 | 9,000 | 10,000 |
| No. of Risers | Heave Period of Conventional Buoyancy Can System 300, seconds | | | | | | |
| 0 | 7.39 | 8.17 | 8.86 | 9.46 | 10.00 | 10.48 | 10.92 |
| 1 | 6.11 | 6.73 | 7.25 | 7.71 | 8.10 | 8.45 | 8.74 |
| 2 | 5.28 | 5.79 | 6.21 | 6.56 | 6.85 | 7.09 | 7.28 |
| 3 | 4.69 | 5.10 | 5.44 | 5.71 | 5.92 | 6.07 | 6.18 |
| 4 | 4.23 | 4.58 | 4.84 | 5.04 | 5.18 | 5.27 | 5.30 |
| 5 | 3.86 | 4.15 | 4.36 | 4.50 | 4.57 | 4.59 | 4.54 |
| 6 | 3.55 | 3.79 | 3.95 | 4.03 | 4.04 | 3.99 | 3.86 |
| 7 | 3.28 | 3.48 | 3.59 | 3.62 | 3.57 | 3.45 | 3.23 |
| 8 | 3.06 | 3.21 | 3.27 | 3.25 | 3.14 | 2.94 | 2.62 |

Turning now to Table 2, heave periods are shown for a tube buoyancy can system 400 having the same buoyancy capacity as conventional buoyancy can system 300 discussed above. Also, like system 300, system 400 is assigned to suspend the same risers, both in number and design, in the same water depth range. As shown, the heave periods for tube buoyancy can system 400 are significantly less than corresponding heave periods for conventional buoyancy can system 300 included in Table 1. In fact, if, following the example presented above, system 400 were used to suspend the same drilling riser for use in a drilling operation in 6,000 feet of water, no additional dummy risers would be required because the heave period of system 400 with a single installed riser is less than 5 seconds. Therefore, by using a tube buoyancy can system 400, rather than conventional buoyancy can system 300, in this hypothetical drilling operation, the costs of the drilling operation are significantly less due to the lack of a need for three additional dummy risers. Moreover, the cost savings increase as the water depth increases, making tube buoyancy can system 400 particularly attractive given the desire to explore and drill in deeper waters.

TABLE 2

| | Water Depth, ft | | | | | | |
|---|---|---|---|---|---|---|---|
| | 4,000 | 5,000 | 6,000 | 7,000 | 8,000 | 9,000 | 10,000 |
| No. of Risers | Heave Period of Tube Buoyancy Can System 400, seconds | | | | | | |
| 0 | 4.19 | 4.69 | 5.14 | 5.55 | 5.93 | 6.29 | 6.63 |
| 1 | 3.53 | 3.95 | 4.32 | 4.67 | 4.99 | 5.29 | 5.58 |
| 2 | 3.10 | 3.47 | 3.80 | 4.11 | 4.39 | 4.66 | 4.91 |
| 3 | 2.80 | 3.13 | 3.43 | 3.71 | 3.96 | 4.20 | 4.43 |
| 4 | 2.58 | 2.88 | 3.15 | 3.41 | 3.64 | 3.86 | 4.07 |
| 5 | 2.40 | 2.68 | 2.93 | 3.17 | 3.39 | 3.59 | 3.79 |
| 6 | 2.25 | 2.51 | 2.75 | 2.98 | 3.18 | 3.37 | 3.56 |
| 7 | 2.13 | 2.38 | 2.60 | 2.81 | 3.01 | 3.19 | 3.36 |
| 8 | 2.02 | 2.26 | 2.48 | 2.67 | 2.86 | 3.03 | 3.20 |

While preferred embodiments have been shown and described, modifications thereof can be made by one skilled in the art without departing from the scope or teachings herein. The embodiments described herein are exemplary only and are not limiting. Many variations and modifications of the systems are possible and are within the scope of the invention. For example, the relative dimensions of various parts, the materials from which the various parts are made, and other parameters can be varied. In particular; tube buoyancy cans 130 are not limited to the circular shapes shown in FIG. 6, but may assume other physical forms. Accordingly, the scope of protection is not limited to the embodiments described herein, but is only limited by the claims that follow, the scope of which shall include all equivalents of the subject matter of the claims.

What is claimed is:

1. A buoyancy can system for tensioning a plurality of top tension risers, the buoyancy can system comprising:

a plurality of tubular cans coupled together and configured to move collectively as a single unit;

wherein the plurality of tubular cans are coupled to the plurality of top tension risers and are configured to apply a tension load to each of the plurality of top tension risers;

wherein each tubular can comprises:

an upper end enclosed by a lid having an opening therein;

a closure device coupled to the lid and configured to close the opening and then open the opening to increase the level of seawater in the tubular can and decrease the tension load applied to the plurality of top tension risers;

an open lower end configured to allow seawater to flow freely into and out of the tubular can; and an inner surface extending between the upper end and the lower end, the inner surface devoid of structural obstructions which substantially inhibit the free flow of seawater through the lower end; and a pressurized gas system configured to selectably inject pressurized gas into one or more of the tubular cans;

wherein, when the opening is open, the tubular can is ballasted by seawater; and wherein, when the opening is closed and pressurized gas is injected into the tubular can, the tubular can is de-ballasted of seawater.

2. The buoyancy can system of claim 1, wherein each opening is configured to allow the free flow of gas therethrough.

3. The buoyancy can system of claim 2, wherein the gas is air.

4. The buoyancy can system of claim 1, wherein the structural obstructions are at least one of dividers separating the tubular can into two or more compartments and stiffeners.

5. The buoyancy can system of claim 1, wherein the pressurized gas system comprises:

a pressurized gas source; and a plurality of flow lines, each flow line coupled between the pressurized gas source and one of the plurality of tubular cans.

6. The buoyancy can system of claim 5, wherein the pressurized gas system is configured to inject pressurized gas into each tubular can independently of the remaining tubular cans.

7. The buoyancy can system of claim 6, wherein the pressurized gas is one of a group consisting of air and nitrogen.

8. The buoyancy can system of claim 1, wherein the plurality of tubular cans have a natural heave period which is substantially unaffected by ballasting and de-ballasting of the plurality of tubular cans.

9. The buoyancy can system of claim 1, further comprising a removable cover coupled over the closeable opening.

10. The buoyancy can system of claim 1, wherein the plurality of top tension risers are disposed within a plurality of interstitial spaces between the plurality of tubular cans.

11. A method for adjustably tensioning a plurality of top tension risers, the method comprising:

(a) coupling a plurality of tubular buoyancy cans together to form a buoyancy can system that moves as a single unit, wherein each tubular buoyancy can of the buoyancy can system comprises:

an enclosed upper end having a closeable opening therein;

an open lower end configured to allow free flow of seawater therethrough; and an inner surface extending therebetween, the inner surface devoid of structural obstructions which substantially inhibit the free flow of seawater through the lower end;

(b) coupling the buoyancy can system to a first top tension riser;

(c) applying a tension load to the first top tension riser with the buoyancy can system;

(d) opening the closeable opening of a first tubular buoyancy can after (c) to ballast the first tubular buoyancy can with seawater;

(e) decreasing the tension load applied to the first top tension riser by the buoyancy can system during (d);

(f) coupling a second top tension riser to the buoyancy can system after (b);

(g) applying a tension load to the second top tension riser with the plurality of tubular buoyancy cans after (b) and (c);

(h) closing the closeable opening of a second tubular buoyancy can;

(i) injecting pressurized gas into the second tubular buoyancy can after (f), (g), and (h) to de-ballast the second tubular buoyancy can of seawater; and (f) increasing the tension load applied to the first top tension riser and the tension load, applied to the second top tension riser by the buoyancy can system during (i).

12. The method of claim 11, wherein the opening comprises removing a cover coupled over the closeable opening.

13. The method of claim 11, wherein the closing comprises coupling a cover over the closeable opening.

14. The method of claim 11, wherein the buoyancy can system comprises a buoyancy and a natural heave period; and wherein ballasting the first tubular buoyancy can with seawater decreases the buoyancy with insubstantial effect to a natural heave period of the buoyancy can system and de-ballasting the second tubular buoyancy can of seawater increases the buoyancy with insubstantial effect to the natural heave period of the buoyancy can system.

15. The method of claim 11, wherein the plurality of top tension risers are disposed within a plurality of interstitial spaces between the plurality of tubular cans.

16. The method of claim 11, wherein the first tubular buoyancy can is a different one of the plurality of tubular buoyancy cans than the second tubular buoyancy can.

* * * * *